US006519877B2

(12) United States Patent
Oetting et al.

(10) Patent No.: US 6,519,877 B2
(45) Date of Patent: Feb. 18, 2003

(54) SNOWBOARD BOOT WITH REMOVABLE UPPER SUPPORT

(75) Inventors: Richard H. Oetting, Vashon, WA (US); John D. Martin, Vashon, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/760,326

(22) Filed: Jan. 12, 2001

(65) Prior Publication Data

US 2002/0092204 A1 Jul. 18, 2002

(51) Int. Cl.[7] ..... A43B 5/04

(52) U.S. Cl. ..... 36/117.1; 36/119.1; 36/107; 36/89

(58) Field of Search ..... 36/117.1, 119.1, 36/88, 89, 45, 115, 114, 136, 109, 107

(56) References Cited

U.S. PATENT DOCUMENTS

| | | | | |
|---|---|---|---|---|
| 3,413,736 A | | 12/1968 | Spiteri | |
| 4,406,073 A | | 9/1983 | Spademan | |
| 4,461,103 A | | 7/1984 | Annovi | |
| 4,835,885 A | | 6/1989 | Hoshizaki et al. | |
| 5,113,526 A | * | 5/1992 | Wang et al. | 2/2 |
| 5,226,875 A | * | 7/1993 | Johnson | 602/27 |
| 5,265,353 A | | 11/1993 | Marega et al. | |
| 5,406,721 A | * | 4/1995 | Marcolin | 36/105 |
| 5,575,090 A | * | 11/1996 | Condini | 36/54 |
| 5,606,808 A | | 3/1997 | Gilliard et al. | |
| 5,701,688 A | | 12/1997 | Crowley | |
| 5,771,609 A | | 6/1998 | Messmer | |
| 5,819,440 A | * | 10/1998 | Okajima | 36/117.1 |
| 5,937,546 A | | 8/1999 | Messmer | |
| 5,966,843 A | | 10/1999 | Sand et al. | |
| 6,012,237 A | | 1/2000 | Okajima et al. | |
| 6,128,837 A | * | 10/2000 | Huang | 36/54 |
| 6,237,253 B1 | | 5/2001 | Feuerecker | |
| 6,283,494 B1 | * | 9/2001 | Bourdeau | 280/617 |

FOREIGN PATENT DOCUMENTS

EP 0 695 515 A2 2/1996

* cited by examiner

*Primary Examiner*—Mickey Yu
*Assistant Examiner*—Jila M Mohandesi
(74) *Attorney, Agent, or Firm*—Christensen O'Connor Johnson Kindness PLLC

(57) ABSTRACT

An embodiment of a snowboard boot with removable upper support includes a sole portion that cooperatively with an upwardly extending boot upper provides a volume for receiving a user's foot. The boot upper has a high back portion that includes an interior pocket adapted to receive a generally Y-shaped stiffening insert. The pocket is provided at the back of the upper, by attaching a back panel to the upper, the back panel having a front panel attached to the front side, thereby forming a pocket. Slots are provided at the top corners of the back panel that can slidably engage the upper tabs of the insert, thereby locking the insert in place.

16 Claims, 5 Drawing Sheets

SNOWBOARD BOOT WITH REMOVABLE UPPER SUPPORT

FIELD OF THE INVENTION

The present invention relates to snowboard boots, and more particularly to snowboard boots having a flexible upper.

BACKGROUND OF THE INVENTION

Snowboarding is a popular winter sport in which a snowboarder stands atop a snowboard and maneuvers the board over the snow, propelled by gravity. The snowboarder wears boots that are removably attached to the board, with the snowboarder's feet angled with respect to the longitudinal axis of the board, and in some cases, perpendicular to the board axis. The snowboard is controlled by weight transfer and foot movement, both lateral and longitudinal.

A primary skill that must be mastered in snowboarding is the ability to carve a path through the snow, rather than simply sliding over the top of the snow. Carving allows the snowboarder to control the direction and speed of the snowboard. In its simplest execution, a snowboarder carves a path through the snow by shifting his or her weight forward or backward, causing the snowboard to tilt or rotate about its longitudinal axis toward and away from its back side edge. As used herein, frontside refers to the side or direction to which the snowboarder's toes are closest and back side refers to the opposite side or direction.

Snowboard boots are conventionally secured to the board using either strap bindings or step-in bindings. In either case, the binding and/or boot usually employs a high back structure that extends upwardly from either the board or the back side of the boot sole, along and behind the ankle of the boot. The high back limits rearward flexure of the ankle so that when the snowboarder leans backwards, force is transmitted to the snowboard tending to rotate the snowboard about its longitudinal axis toward the back side edge. The high back is secured to the board in conventional strap bindings and in high back step-in bindings.

An alternative type of step-in binding is also available, called a plate or flat step-in binding. Flat step-in bindings utilize metal cleats on the bottom of the snowboard boot that mate with a binding structure built into the snowboard, to secure the snowboard boot to the snowboard. For example, two metal cleats are sometimes provided on the bottom of each boot, one toward the front portion of the boot and the other toward the heel of the boot. Step-in bindings provide many advantages over strap and high back step-in bindings, including ease of attachment and disattachment. The flat step-in binding itself, however, does not provide a connection between the snowboarder's calf and the frontside of the snowboard. Therefore, in order to facilitate back side turns, snowboard boots for use with flat step-in bindings are typically much stiffer, particularly along the vertical back portion of the upper, than are snowboard boots for strap and high back step-in bindings. The functional equivalent of the high back is essentially built into the snowboard boot for flat step-in bindings, rigidizing the rear spine of the boot against rear flexion.

The choice of binding type and boot will depend on a variety of factors. For example, in alpine snowboarding, wherein the snowboarder typically maneuvers from the top to the bottom of a snow-covered slope, it is generally preferred to have a stiffer connection between the snowboarder and the snowboard. In free style snowboarding, which typically involves performing more elaborate tricks, more mobility and flexibility between the snowboarder and the snowboard is desirable. Two or more different pairs of snowboard boots may therefore be necessary for a snowboarder who wants to do both alpine and free style snowboarding: One pair of boots for use with strap or high back step-in bindings, another pair of boots for flat step-in bindings, and possibly a third pair of boots for use with flat step-in bindings that has a greater degree of flexibility in the ankle portion.

In U.S. Pat. No. 5,966,843 to Sand et al., a boot structure is disclosed for use with step-in bindings including an underfoot or shank portion that connects to a heel cup and high back portion. Straps are provided from the high back portion to the shank, whereby backward motion of the high back portion will cause the shank to rise. This boot essentially combines the features of a high back binding and a step-in binding into a soft boot structure.

A similar stiffening assembly is disclosed in U.S. Pat. No. 5,771,609 to Messmer, which teaches a boot insert including a rigid underfoot portion pivotally attached to a rigid back plate, and a pair of flexible tension straps extending between the back plate and the underfoot portion. Neither Messmer nor Sand et al. teaches a stiffening apparatus that can be removed from the boot.

In U.S. Pat. No. 5,606,808, Gilliard et al. teaches a snowboard boot having at least one elongate exterior pocket in the flexible upper portion of the boot with an open top channel to receive a substantially uniform rectilinear cross-sectional elongate stay, for stiffening the upper portion of the boot. The stay, which is maintained in the pocket by frictional forces, includes a strap for inserting and removing the stay, whereby the snowboarder can adjust the stiffness of the boot upper portion. The elongate stay does not, however, conform to the shape of the snowboarders ankle, and is susceptible to being inadvertently pulled out during use, for example if the snowboarder tumbles in the snow or brushes against obstacles on the slope.

SUMMARY OF THE INVENTION

The present invention provides a boot for snow sports having a sole portion and an upper portion that cooperatively receive a user's foot. The upper portion has a flexible high back portion adapted to surround the user's ankle. The high back portion includes a pocket that is adapted to receive a removable, semi-rigid insert that is wide at a top end and narrow at a bottom end. By installing or removing the insert in the pocket, the rearward flexibility of the high back portion of the boot can be selectively modified.

In a further aspect of the present invention, the insert is generally Y-shaped, and the high back portion of the boot also includes a pair of locking slots that are positioned to receive opposite corners of the top end of the insert, such that the insert can be removably locked in place in the pocket.

In an aspect of one embodiment of the present invention, the snowboard boot further comprises a soft liner that is insertable into the boot to improve the user's comfort.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
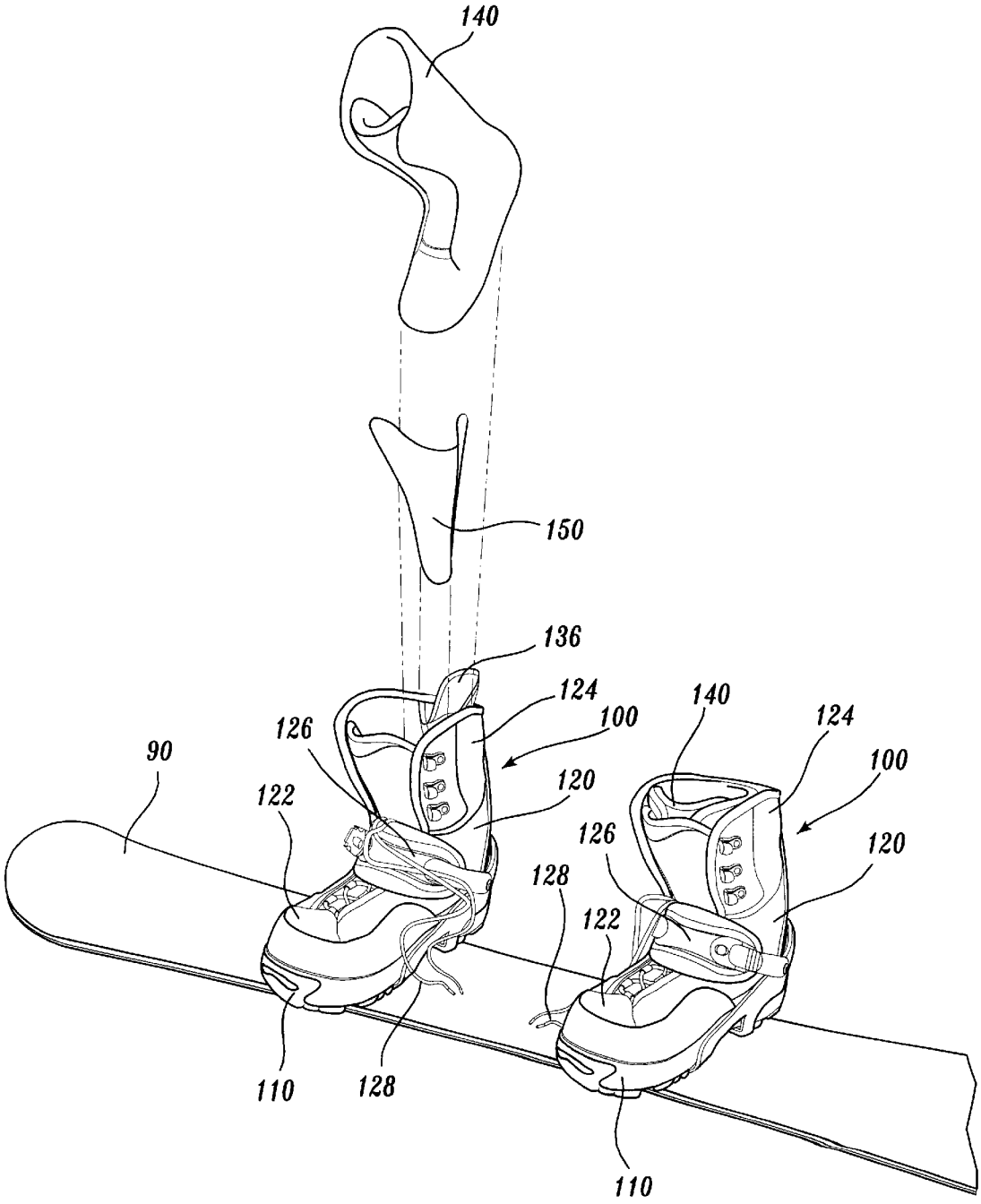
FIG. 1 is a perspective, partially exploded view of a pair of snowboard boots made in accordance with the present invention, shown atop a snowboard.

A snowboard boot made in accordance with a preferred embodiment of the present invention is illustrated in FIG. 1, which shows a perspective, partially exploded view of two snowboard boots 100 on a snowboard 90. Each snowboard boot 100 includes a sole portion 110, and a boot upper 120 that is connected to, and extends upwardly from, the sole portion 110. The boot upper 120 has a lower, or toe portion 122 that, cooperatively with the sole portion 110, generally encloses a user's foot (not shown), and a high back portion 124 that wraps around the user's ankle (also not shown). A soft, compressible liner 140, smaller than the boot 100 and generally conforming to the shape of the user's foot, is provided between the snowboard boot 100 and the user's foot, to increase the comfort of and more closely conform to the user. A strap 126 and/or laces 128 may be used to secure the snowboard boot 100 tightly about the user's foot and ankle. If step-in bindings are to be used, the sole portion 110 will further include cleats (not shown) or other engaging members on its bottom side that engage corresponding plate bindings on the snowboard 90.

The disclosed invention is adapted for use with a "soft" boot. A "soft" boot upper is typically formed of a flexible material, for example, a pliable leather, a woven fabric material such as polymeric canvas, polymeric sheet material or a layered combination of such materials. Such flexible materials are selected to provide a relatively comfortable fit to the user and to provide a limited range of motion at the ankle joint. In particular the high back portion 124 may be constructed from fabric, leather, elastomers, or combinations of these materials, by way of nonlimiting example. The flexible high back portion 124 of the boot, and therefore, the user's ankle, can flex or rotate about a transverse axis, with respect to the toe portion 122, and therefore, the user's foot. The high back portion 124 permits fore and aft, and lateral and medial, flexure. This flexure provides a degree of mobility to the user's ankle joint, which is important in some snowboarding maneuvers, particularly in free style snowboarding. The soft boot is also typically more comfortable to the user than a hard shell boot.

As discussed above, it is sometimes desirable to provide stiffer support to the user's ankle and a more limited range of motion at the ankle joint, particularly in the aft direction, for example, to enable the user to more easily control axial rotation of the snowboard. The desired stiffness in the boot 100 will depend upon several factors, including the user's preference and skill level, the type of binding used, and on the type of snowboarding in which the user will be engaging.

Figure 2:
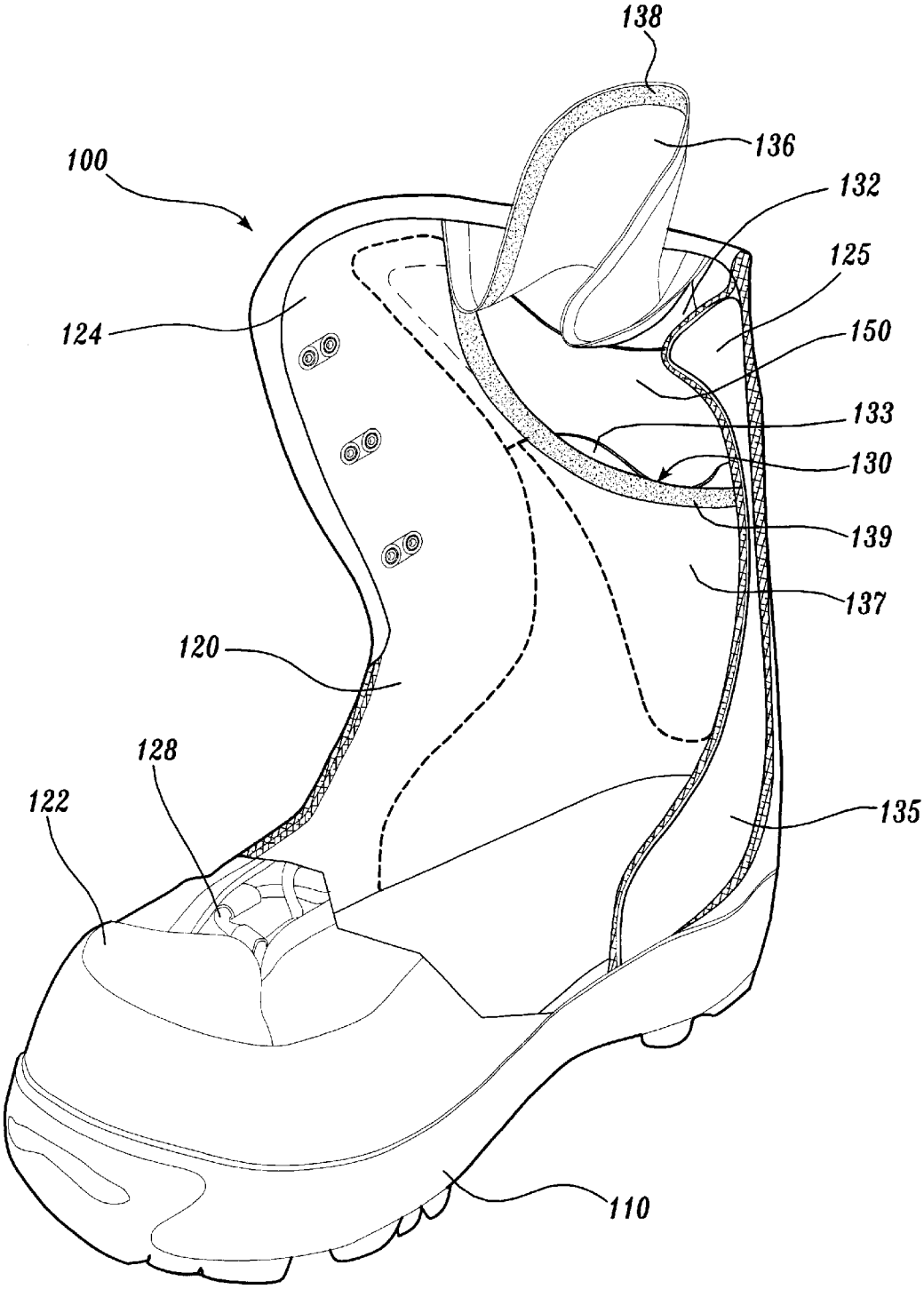
FIG. 2 is a partially cutaway perspective view of the snowboard boot shown in FIG. 1.
Figure 3:
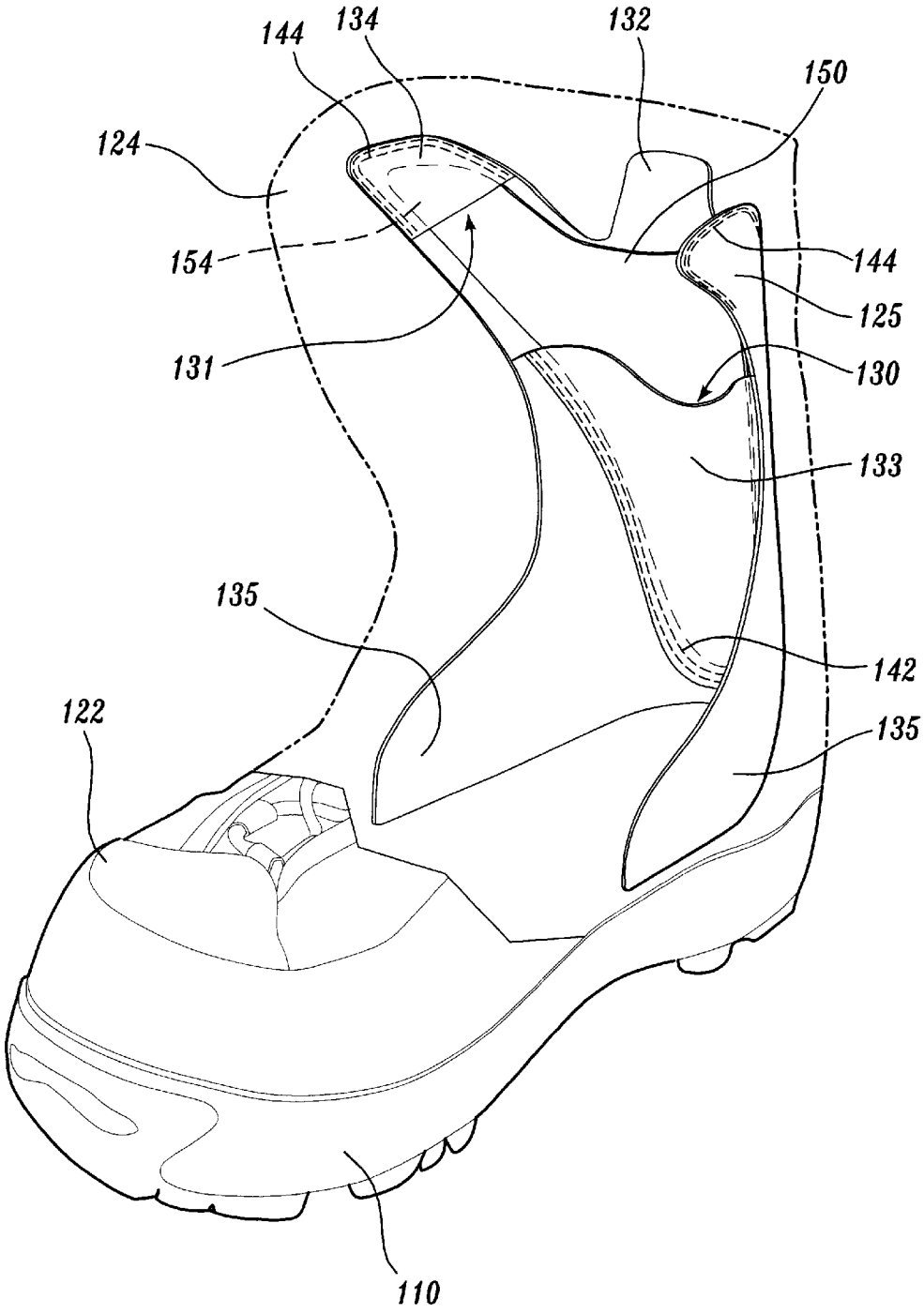
FIG. 3 is a further cutaway perspective view of the snowboard boot shown in FIG. 1.

As shown in FIGS. 1–3, the boot 100 includes a curvilinear stiffening insert 150 that is removably insertable into the boot upper 120, between the boot upper 120 and the liner 140. A pocket 130 is provided in the back interior of the boot upper 120, which slidably receives the insert 150. The pocket 130 includes a back panel 132 that is attached to, and conforms to, the boot upper 120, and a smaller front panel 133 attached to the front of the back panel 132 as discussed in more detail below. In the currently preferred embodiment, the front and back panels 132, 133 are made from a semi-rigid material, providing a predetermined degree of stiffness to the boot upper 120, although a more flexible pocket—for example, made from leather or a similarly pliable material—is also possible and contemplated by this invention. The back panel 132 is preferably attached to the boot upper 120 with an epoxy, although other attachment methods are possible and known in the art, including sewing or riveting the back panel to the upper, providing a frame that holds the back panel in place, or having the back panel formed integrally with the boot upper material.

The back panel 132 has a curvilinear profile that generally matches the desired shape of the portion of the boot upper 120 to which it is attached. It will be appreciated that the back panel 132 therefore provides the additional benefit of tending to hold the boot upper 120 in the desired shape. In the preferred embodiment illustrated, the back panel 132 also includes a lower portion that has a pair of elongate lower wings 135 extending forward from bottom edge of the back panel 132 and generally adjacent to the upper surface of the sole portion 110. The lower wings 135 cooperatively with the back portion of the sole 110 therefore form a heel cup. The lower wings 135 provide the boot 100 and the user with additional support, by generally surrounding the user's heel. Similarly, the top of the back panel 132 includes a pair of upper wings 125 that extends forwardly from the top edge of the back panel 132. The upper wings 125 wrap partially around the user's ankle, whereby the back panel 132 provides lateral or side-to-side stability to the boot upper 120 as well as forward and backward stability.

The front panel 133 is smaller than the back panel 132 and is attached to the front face of the back panel 132. In the disclosed embodiment, the front panel 133 is also semi-rigid and is sewn to the back panel 132 generally along both sides and at the bottom edge of the front panel 133. As seen most clearly in FIG. 5, the front panel 133 is shaped such that when the front panel 133 is attached to the back panel 132, the central portion of the front panel 133 is disposed forward from the back panel 132, thereby forming a pocket 130 therebetween that is open at the top. In the disclosed embodiment the pocket 130 is formed by forwardly extending sections 145 near the side edges of the front panel 133. It will be apparent to one of skill in the art that a pocket could also be formed in other ways, including by providing the front panel 133 with a radius of curvature that is greater than the radius of curvature of the back panel 132. Alternatively, the front panel 133 can simply be formed with sufficient flexibility that it can be pulled away from the back panel 132 for insertion of the insert 150. It will also be apparent that other configurations are possible, for example the pocket opening could be provided on the left or right side, and an insert provided that will slide sideways into a side pocket.

The front panel 133 is widest at the open top, and decreases uniformly in width from the top to the bottom. In the currently preferred embodiment, the front panel 133 is attached to the back panel 132 with stitches 142, generally conforming to the shape of the front panel 133, although other attachment methods could also be used. The pocket 130 is therefore open at the top, and decreases uniformly in width from the top to the bottom.

Figure 4:
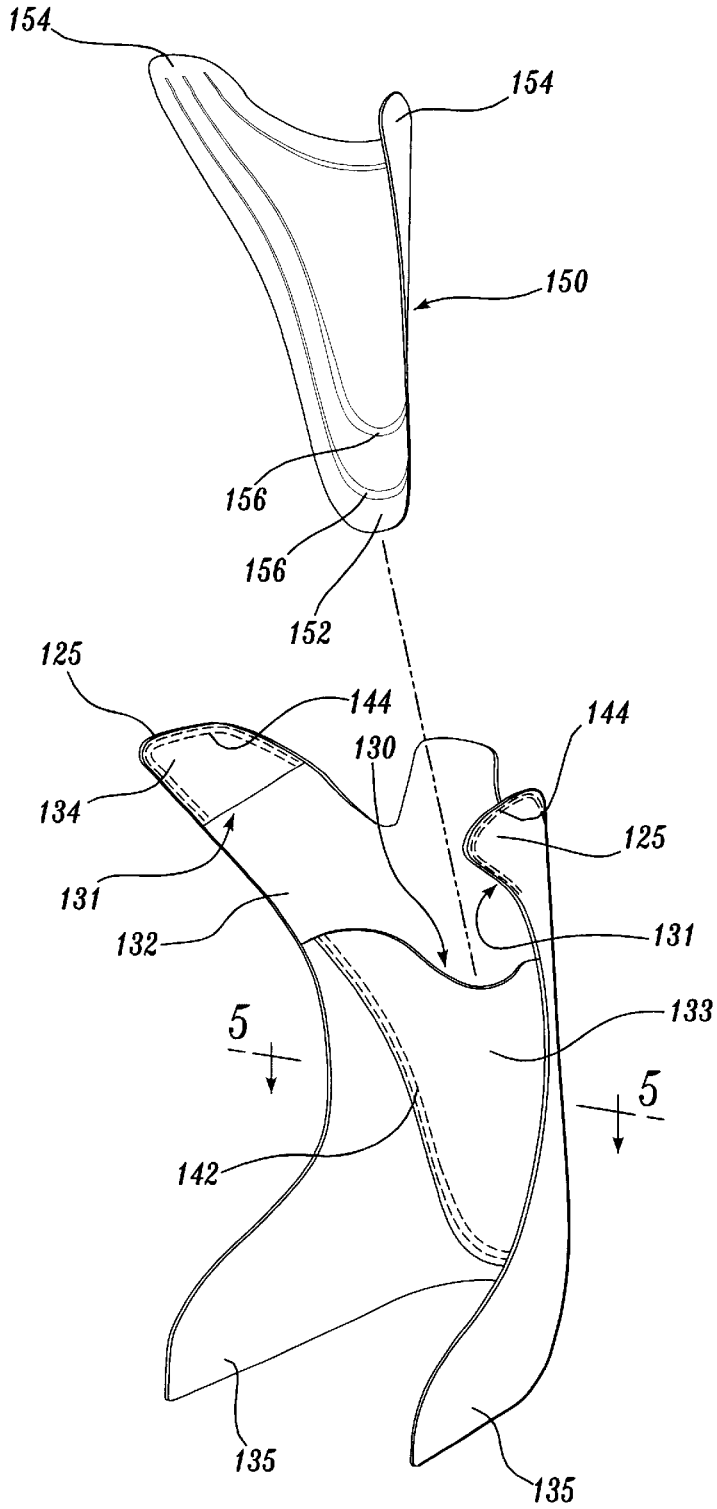
FIG. 4 is a perspective, view of the pocket assembly and insert of the snowboard boot shown in FIG. 1.

Two locking strips 134 are attached at the top portion of the upper wings 125 of the back panel 132, as seen most clearly in FIG. 4. The locking strips 134 are attached generally along the upper and side edges by stitches 144, thereby forming small, downwardly-opening pockets or locking slots 131 on each side of the upper edge of the back panel 132. It will be apparent to one of skill in the art that equivalent locking slots could be provided in other ways. For example, slots could be integrally formed in the back panel by cutting slits at appropriate locations and forming a portion of the back panel above the slot to project outwardly from the face of the back panel. Alternatively, the back panel could be formed with a portion that folds over to form a locking slot. The locking slots 131 function to receive and retain the removable stiffening insert 150 in place, as discussed below.

Figure 5:
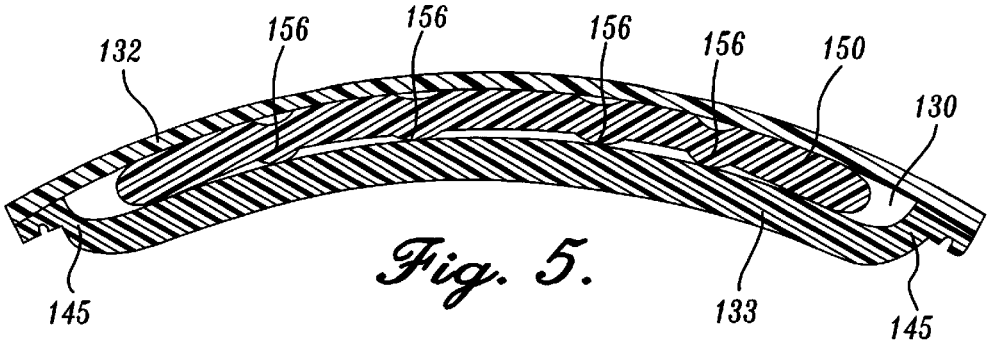
FIG. 5 is a cross-sectional view along line 5—5 of FIG. 4, showing the insert installed in the pocket.

A curvilinear, generally Y-shaped insert 150 can be removably inserted into the pocket 130, as shown in FIG. 4. The insert 150 has a narrow lower tongue 152 extending downwardly, and increases uniformly in width from the bottom of the tongue 152 to the top, where a pair of elongate sections, or locking tabs 154, extend upwardly and outwardly. FIG. 5 shows a cross sectional view of the insert 150 inserted into the pocket 130 (taken along line 5—5 of FIG. 4). The insert 150 is smaller than, and generally matches the shape of, the pocket 130, whereby the insert tongue 152 substantially fills the pocket 130. As seen most clearly in FIG. 3, the insert 150 is longer than the pocket 130, so when the insert 150 is fully inserted into the pocket 130, the top portion of the insert 150, including the pair of locking tabs 154, extends out of the top of the pocket 130.

The insert 150 is sized and shaped such that when the insert 150 is fully inserted into the pocket 130, the locking tabs 154 overlie the locking slots 131. The insert 150 and the back panel 132 have sufficient flexibility that they can be elastically deformed to allow the locking tabs 154 to be inserted into the locking slots 131, thereby locking the insert 150 in the pocket 130, and securing the insert 150 against the back of the upper 120. To lock the insert 150 into the slots 131, for example, a back panel 132 upper wing 125 is grasped (with the associated section of the upper high back portion 124) and rotated back and outward, with respect to the rest of the boot 100. The corresponding locking tab 154 of the insert 150 is grasped with the other hand and deflected back and inwardly, until the locking tab 154 slidably engages the locking slot 131. The process is then repeated on the other side.

Similarly, the back panel 132 and insert 150 can be elastically deformed to remove the locking tabs 154 from the slots 131, by repeating the steps described above and slidably disengaging the locking tabs 154 from the slots 131. It will be appreciated that the insert 150 is curved in the transverse plane, such that the insert generally matches the contours of the back panel 132 and the front panel 133. Therefore, the upper portion of the insert 150 and particularly the locking tabs 154 will partially wrap around the user's leg, just above the ankle. The insert 150 will therefore provide additional rigidity or stability in the lateral direction, that is, side to side with respect to the user, as well as forward and backward stability. It will be appreciated that the locking tabs 154 could be attached to the back panel 132 in other ways, for example, by providing snaps on the locking tabs 154 and the back panel 132, or using loop and hook-type fasteners.

Figure 6:
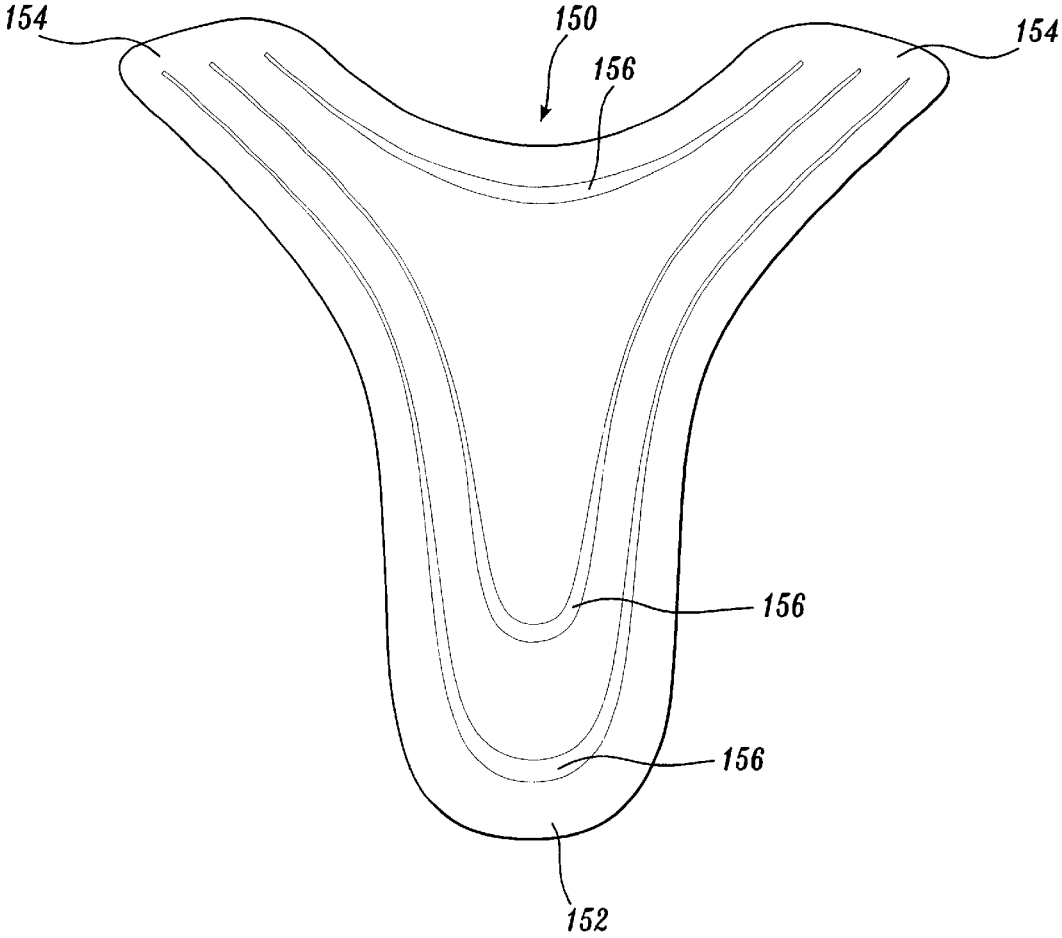
FIG. 6 is a flat pattern view of the insert of the snowboard boot shown in FIG. 1.

In the disclosed embodiment, generally vertically and transversely extending ribs 156 are provided on the insert 150, to increase the rigidity of the insert 150. As seen most clearly in FIG. 5, the ribs 156 also reduce the area of the insert 150 that contacts the interior of the pocket 130, thereby reducing the frictional forces during insertion and removal of the insert 150. FIG. 6 is a flat-pattern view of the insert 150, showing the general Y-shape of the insert. The ribs 156 generally follow the edge contour of the insert 150.

The insert 150 may be formed of any suitably semi-rigid material having sufficient strength and shape stability, including by way of non-limiting example, a semi-rigid nylon™ polymer, or a carbon fiber reinforced composite. The desired combination of rigidity and flexibility can be further selectably achieved by modifying the geometry of the insert, for example the thickness of the material or the number and/or size of surface features such as ribs 156. Although in the preferred embodiment the back panel 132 and front panel 133 are made from a similar semi-rigid material, it is also contemplated that the panels 132, 133 could be made from a more flexible material, such as a woven fiber material or leather.

A lining 137 covers the interior of the upper 120. The lining includes a flap 136 that is attached to the top of the upper 120, and provides access to the pocket 130. A hook and loop type fastener 138 is provided on the flap 136, that is alignable with a matching hook and loop type fastener 139 on the body of the liner 137, to allow the flap 136 to be secured in a closed position, whereby the liner 137 covers the back panel 132, front panel 133, and insert 150.

It will be appreciated that the present invention allows the user to selectively control the stiffness of the snowboard boots by inserting or removing the insert 150 from the pocket 130. It is contemplated that multiple inserts can be provided for a single boot, the multiple inserts having differing stiffness characteristics, whereby the user can selectively achieve varying degrees of boot upper flexibility. In particular, a snowboard boot made in accordance with the present invention could be used with different types of bindings. If the snowboarder is using the boots with a high back style binding, enhanced stiffness in the boot may not be required because the binding attached to the snowboard will provide the requisite board control. The insert 150 may be removed for such cases. Even with a high back style binding, however, the added lateral stability provided by the insert may be desirable. Alternatively, if step-in plate bindings are to be used, where greater boot stiffness is generally preferred, the snowboarder can simply slide the insert 150 into the pocket 130. An additional advantage of the present invention is that it would allow the snowboarder to spread out the cost of upgrading to step-in bindings over more than one season. If the snowboarder desired to switch to step-in bindings, for example, he or she could purchase boots made in accordance with the present invention in one season, and use them with an existing strap binding, and then upgrade the snowboard in a subsequent season.

Although the disclosed embodiment has been described having an interior pocket, it is also contemplated by the present invention that the pocket could be formed on the outside of the snow boot upper such that an insert wrapping partially around the snowboarder's ankle can be inserted into the pocket without removing the boot. This alternative embodiment would have the advantage that the interior of the boot would not have to accommodate the insert and therefore a boot without a removable liner 140 could be used.

Although the invention has been described with reference to the preferred embodiment wherein a pocket is provided in the boot to retain the insert, other means for retaining a rigid or semi-rigid insert are also contemplated within the scope of the present invention. For example and without limitation, it is contemplated that a plurality of short retainer tabs could be provide in the boot upper to retain an insert at three or more attachment locations. Alternatively, a simple flexible flap at the top of the upper, or an elastic strap, could be employed to retain the insert cooperatively with the user's foot and/or the liner. More positive locking mechanisms, such as snaps or hooks and hoops type fasteners could also be attached to the boot upper and the insert to lock the insert at the desired location within the boot.

It should be readily apparent to those of ordinary skill in the art that additional alterations could be made to the above-described embodiment. For instance, the pocket for the insert could be formed as a unitary pocket from a single piece of material. Further, the insert could be formed with a strap, hoop, or other grasping device to facilitate insertion and/or removal of the insert from the boot. Also, a stacked, multipart insert could be used wherein the stiffness of the upper can be adjusted by changing the number of inserts that are inserted in the pocket. Although the present invention has been described with reference to snowboard boots, the application for which the invention was developed, it is also contemplated that the invention will find application in other sporting footwear in which varying degrees of boot upper stiffness may be desired.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snowboard boot comprising:

a. a sole portion having a bottom side and a top side;

b. an upper portion attached to said top side of said sole portion, said upper portion including a toe portion and a flexible high back portion;

c. said flexible high back portion having a posterior pocket; and d. a semi-rigid insert that is wide at a top end and narrow at a bottom end, said semi-rigid insert being slidably insertable into said posterior pocket;

wherein said top of said semi-rigid insert further comprises two oppositely disposed tab portions extending generally upwardly therefrom, and wherein said flexible high back portion further comprises two slots that are positioned and adapted to lockingly engage said tab portions when said semi-rigid insert is slidably inserted into said posterior pocket.

2. The snowboard boot of claim 1, wherein said posterior pocket is interiorly disposed.

3. The snowboard boot of claim 1, wherein said semi-rigid insert is curved in a transverse plane such that said insert generally conforms to the contour of said upper portion.

4. The snowboard boot of claim 1 further comprising a soft liner that is removably insertable into said upper portion.

5. The snowboard boot of claim 1, wherein said semi-rigid insert defines at least one elongate stiffening rib.

6. The snowboard boot of claim 1, wherein said flexible high back portion further comprises a flap attached to said flexible high back portion above said posterior pocket, said flap adapted to overlie a portion of said posterior pocket.

7. The snowboard boot of claim 1, wherein said semi-rigid insert has a thickness between 0.5 mm and 2.0 mm.

8. The snowboard boot of claim 1, wherein said posterior pocket comprises a back panel attached to an interior surface of said flexible high back portion and a front panel attached to said back panel along a portion of a perimeter of said front panel.

9. The snowboard boot of claim 8 wherein said back panel is formed from a semi-rigid elastomeric material.

10. A snowboard boot comprising:

a. a sole portion having a bottom side and a top side;

b. an upper portion attached to said top side of said sole portion, said upper portion including a toe portion and a flexible high back portion;

c. said high back portion having a posterior pocket; and d. a semi-rigid insert that is wide at a top end and narrow at a bottom end, said semi-rigid insert being slidably insertable into said posterior pocket;

wherein said posterior pocket comprises a back panel attached to an interior surface of said flexible high back portion and a front panel attached to said back panel along a portion of a perimeter of said front panel; and wherein said back panel further comprises a first pair of oppositely disposed wings extending generally forwardly from a bottom end of said back panel and a second pair of oppositely disposed wings extending generally forwardly from a top end of said back panel wherein said first and second pairs of wings are attached to said upper portion.

11. A boot for snow sports, said boot comprising:

a. a sole and a flexible high back upper cooperatively forming a volume, said upper further comprising means for tightening said flexible high back upper;

b. an interior pocket in said flexible high back upper disposed generally opposite said tightening means;

c. a semi-rigid insert that is generally Y-shaped, having a wide top end having a pair of oppositely disposed elongate sections, said semi-rigid insert being adapted to be slidably inserted into said interior pocket, whereby said semi-rigid insert extends from near a bottom of said flexible high back upper to near a top of said flexible high back upper; and d. means for selectively locking said insert into said pocket comprising two slots in said flexible high back upper located and adapted to each receive one of said pair of elongate sections.

12. The boot of claim 11, wherein said semi-rigid insert is curved in a transverse plane such that the shape of said semi-rigid insert generally conforms to the shape of said flexible high back upper.

13. The boot of claim 11, further comprising a soft liner that can be removably inserted into said volume cooperatively formed by said sole and said flexible high back upper.

14. The boot of claim 11, wherein said semi-rigid insert further comprises at least one longitudinal stiffening rib.

15. The boot of claim 11, wherein said flexible high back upper further comprises an interior flap attached to said flexible high back upper above said interior pocket.

16. An improved soft snowboard boot of the type having a hard sole and a flexible high back upper that wraps around a user's ankle, the improvement comprising:

a. a pocket on a back surface of said flexible high back upper; and b. a semi-rigid insert that removably slides into said pocket, said semi-rigid insert being curvilinear to generally conform to said user's ankle, whereby said user can selectively increase the rigidity of said flexible high back upper;

wherein said flexible high back upper further comprises a plurality of downwardly-opening smaller pockets, and said semi-rigid insert is generally Y-shaped, comprising a central tongue portion and a plurality of upwardly extending locking tabs adapted to be slidably inserted into said plurality of downwardly-opening smaller pockets after said semi-rigid insert is slid into said pocket, whereby said semi-rigid insert is held firmly to said flexible high back upper.

* * * * *